United States Patent [19]

Hellkamp

[11] Patent Number: 4,656,961

[45] Date of Patent: Apr. 14, 1987

[54] ARTICULATED MOORING DEVICE

[75] Inventor: Leo A. Hellkamp, Cincinnati, Ohio

[73] Assignee: Gerrard Brothers, Incorporated, Davenport, Iowa

[21] Appl. No.: 866,652

[22] Filed: May 27, 1986

[51] Int. Cl.[4] ..... B63B 21/00

[52] U.S. Cl. ..... 114/230; 267/73

[58] Field of Search ..... 114/230; 267/69, 73, 267/74

[56] References Cited

U.S. PATENT DOCUMENTS

| | | | |
|---|---|---|---|
| 2,552,424 | 5/1951 | Gorman | 114/230 |
| 3,041,060 | 6/1962 | Jacobsen | 267/73 |
| 3,389,675 | 6/1968 | Kieff et al. | 114/230 |
| 4,022,450 | 5/1977 | Smith | 114/230 |
| 4,206,717 | 6/1980 | Okuda | 114/230 |

FOREIGN PATENT DOCUMENTS

| | | | |
|---|---|---|---|
| 2745890 | 4/1978 | Fed. Rep. of Germany | 114/230 |

*Primary Examiner*—Galen Barefoot
*Assistant Examiner*—Stephen P. Avila
*Attorney, Agent, or Firm*—Henderson & Sturm

[57] ABSTRACT

Disclosed is a mooring device for mooring a vessel to a mooring object, whether fixed or floating; e.g., a dock, dolphin, another vessel, etc. The device comprises an elongated beam from which a pair of arms, offset lengthwise of the beam, project in opposite directions to remote or distal ends. The arms normally occupy positions standing straight out from the beam while the distal ends of the arms are tied respectively to the vessel and to the mooring object. The arms are biased to the stand-out positions but may yield as the vessel moves because of active water, wind and the like. The biasing elements are preferably nylon-covered shock cord.

6 Claims, 5 Drawing Figures

ARTICULATED MOORING DEVICE

BACKGROUND AND SUMMARY OF THE INVENTION

Various forms of mooring devices have been been used in the past for mooring vessels to docks, dolphins, other vessels, etc. and most of these have some form of provision for accommodating vessel movement because of active water, wind, etc. Some devices are telescopic in nature, but these suffer the disadvantage that, when fully telescoped, they become rigid columns and often result in damage to the vessel. Other devices are simple mooring lines of a fixed length that is more often than not exceeded by the amount of movement of the vessel away from the mooring object. Other devices have to be supplemented by various forms of fenders, buffers and similar shock-absorbing means, but these all lead to hull damage because of shock and abrasion.

The present invention features a device that eliminates most if not all of the foregoing disadvantages while providing for a flexible structure of simple and inexpensive design and construction. The device can be used in conjunction with single or multiple mooring lines and itself may be used singly or in multiples. The inventive device absorbs the shock forces that tend to be transferred to the hull of the vessel by severe waves, current, etc. The device also further reduces shock imparted to the typical mooring lines.

The novel mooring device lends itself to variations in size to accommodate vessels of different sizes while yet retaining the structural features that make the device a practical, useful and long-lived structure.

Features and advantages other than those pointed out above will appear as a preferred embodiment of the invention is disclosed in detail in the ensuing description and accompanying drawings.

DETAILED DESCRIPTION OF A PREFERRED EMBODIMENT OF THE INVENTION

Figure 1:
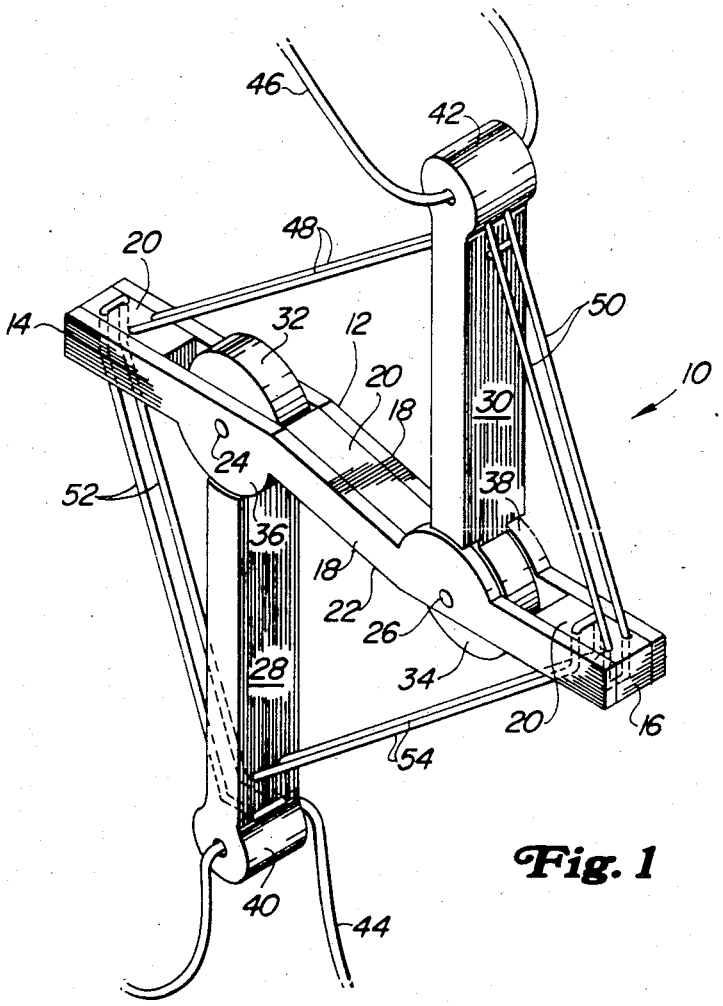
FIG. 1 is a perspective of the device by itself.

Reference will be had first to FIG. 1, where the inventive structure is designated as a whole by the numeral 10, preferably comprising an elongated rigid beam 12 having opposite ends 14 and 16. The beam may be of any material having requisite strength and durability, including resistance to corrosion, etc., and is made up of a pair of parallel, spaced apart side members or bars 18 rigidly held in spaced-apart relation by a plurality of spacers 20, which may be secured to the bars in any appropriate manner. The beam is so configured as to have a lateral offset portion 22 intermediate its ends. The dimensions of the beam will, of course, vary according to the size range of the vessels with which it is intended to be used. The structural material may be steel, aluminum or the like, again depending upon anticipated loads and forces.

The beam is provided with first and second pivots 24 and 26, each in the form of a shaft or axle, the pivot 24 being located adjacent to but spaced longitudinally inwardly of the beam first end 14 in the space between proximate spacers 20, and the other pivot is symmetrically located relative to the other beam end 16. Each shaft spans the side bars of the beam and respectively carries first and second rigid arms 28 and 30, the beam-proximate ends of which are respectively journaled or rotatable on the pivot shafts. The pivoted ends of the arms are enlarged in radial aspects at 32 and 34 respectively, as are proximate portions of the beam bars at 36 and 38 respectively, all for the purpose of increasing the bearing areas between the beam and the arms.

The arms respectively have distal or remote ends 40 and 42 and these are respectively equipped with means for attaching the ends of the arms to a dock, vessel, dolphin, etc. It is preferred that the means be articulate or universal. For the present, flexible ties 44 and 46, respectively, are shown; although, any suitable tie-up means could be used. In its quiescent or unloaded state, the device occupies the condition shown best in FIG. 1. The arms stand out substantially normal to the length of the beam and, of course, project outwardly from the beam in opposite directions and are biased to those positions by biasing means, here in the form of two pairs of dual stretchable tensioning elements, the first pair including dual elements 48 and 50 and the second pair including dual elements 52 and 54. Each element is preferably nylon-covered shock cord or its equivalent. The several elements are connected between the distal ends of the arms and the first and second ends of the beams in such manner as to bias the arms to the positions shown in FIG. 1. As will be evident, the arms may rock independently about their respective pivots, varying the loading on the associated biasing elements accordingly. It will be noted that each arm is tied independently to the beam by its two opposed elements; for example, the arm 28 is tied to the opposite ends of the beam by the elements 52 and 54, which applies to the other arm as respects its elements 48 and 50. The elements as a whole form a parallelogram pattern. The offset at the center of the beam increases the flexibility of the device, especially in the vertical position or near vertical positions of the device.

Figure 2:
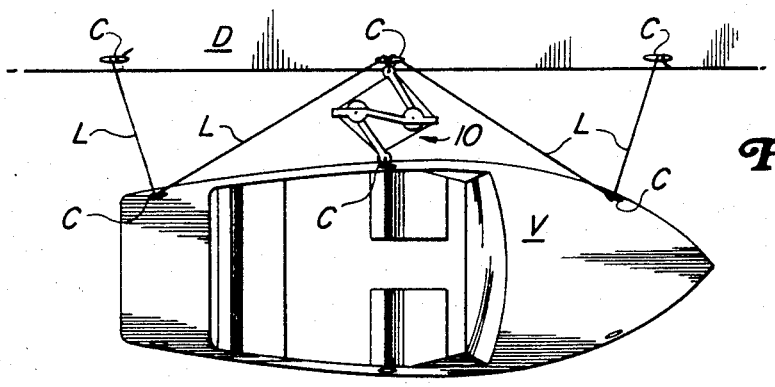
FIGS. 2 through 5 are reduced-scale views showing typical uses of the device singly or in multiples.

In FIG. 2, a single device 10 is shown as being used between a vessel V and a dock D in conjunction with a plurality of mooring lines L (or a single line wrapped as a "W".) The vessel and the dock are depicted as having a plurality of typical tie-up cleats C. Because of this type of tie-up, the device will absorb forces tending to move the vessel toward the dock, the shock cords yielding accordingly.

Figure 3:
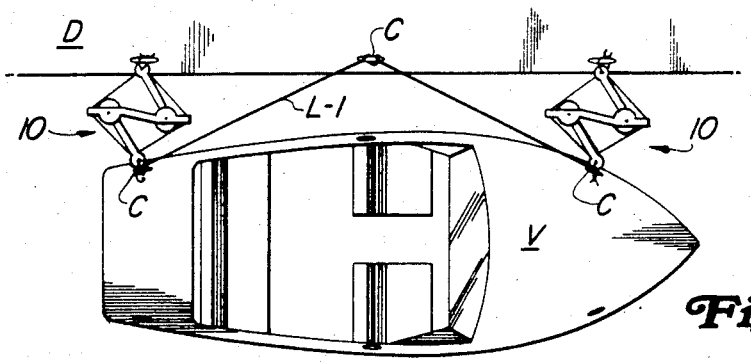

In FIG. 3, two devices are shown as being used with a different type of mooring line arrangement L-1, the devices being disposed fore and aft of the vessel. The tendency here is for the vessel to rock generally horizontally about the center dock cleat but this is yieldingly resisted by the devices 10. The devices also, of course, control movement of the vessel toward and away from the dock.

Figure 4:
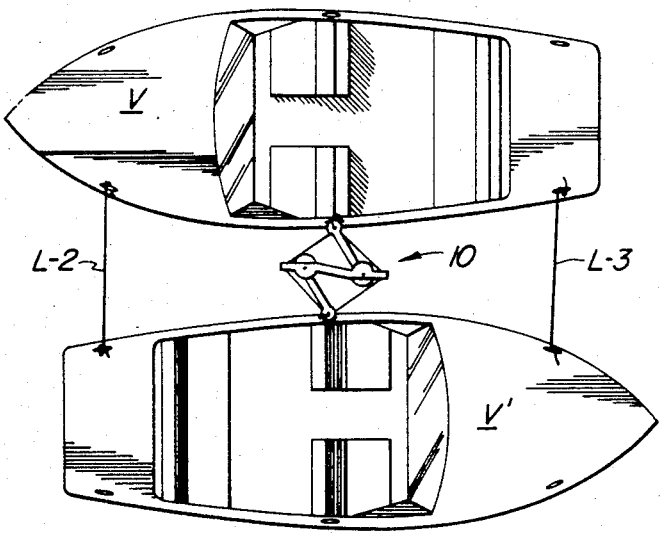

In FIG. 4, two vessels V and V' are moored together with lines L-2 and L-3 with a single device 10 between them. The vessels can have various types of relative movement, all accommodated by the device 10.

Figure 5:
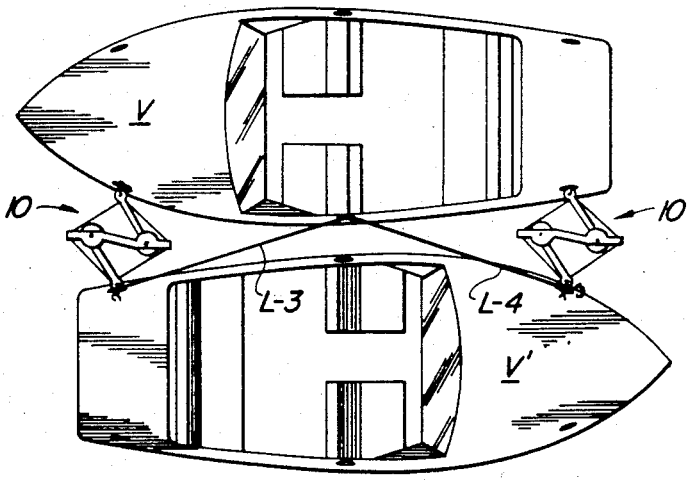

FIG. 5 shows a variation of the tie-up of FIG. 4 where a pair of lines L-4 and L-5 are used between the vessels V and V' along with a pair of devices 10.

The offset at the central part of the structure facilitates folding of the structure for storage. To further facilitate storage, the tension members may be detachable so as to relieve on the arms.

From the foregoing, it will be seen that the improved mooring device is flexible as to construction, use and availability. The drawings show representative uses and others will occur to those versed in the art, as will many modifications in the preferred embodiment of the invention, all of which may be exploited without departure from the spirit and scope of the invention.

I claim:

1. A flexible mooring device adapted for disposition in the space between a vessel and a mooring object, comprising an elongated rigid beam having first and second opposite ends and including first and second parallel pivots disposed crosswise of the beam and spaced apart lengthwise of the beam and being further spaced respectively inwardly of the beam ends, a first rigid arm having one end connected to the beam via the first pivot and extending away from the beam to a distal end, said distal end having means for effecting connection thereof to a vessel, a second rigid arm having one end connected to the beam via the second pivot and extending away from the beam oppositely to the first arm and having a distal end including means for effecting connection to a mooring object, and a plurality of yieldable means connected between the beam and the arms for normally maintaining the arms in extended positions as respects the beam while enabling yieldable rocking of the arms about their respective pivots.

2. The mooring device according to claim 1, in which the yieldable means comprises two pairs of stretchable tensioning elements, the elements of the first pair being connected to the distal end of the first arm and extending toward and connected respectively to the beam ends and the elements of the second pair being connected to the distal end of the second arm and extending toward and connected respectively to the beam ends.

3. The mooring device according to claim 2, in which the four elements are disposed substantially in parallelogram fashion while the arms are in their normal positions.

4. The mooring device according to claim 2, in which the beam includes a pair of transversely spaced apart bars having spacers affixed therebetween, the pivots traverse the bars intermediate the spacers, and the pivoted ends of the arms are received between the spaced bars.

5. The mooring device of claim 4, in which portions of the bars in the areas of the pivots are enlarged radially as respects the pivots and the pivoted ends of the arms are correspondingly enlarged to provide increased bearing surfaces between the arms and the beam.

6. The mooring device of claim 1, in which the beam is shaped at its midportion in such fashion that the first end of the beam is offset toward the distal end of the first arm and the second end of the beam is oppositely offset toward the distal end of the second arm.

* * * * *